US005490823A

United States Patent [19]

Awbrey et al.

[11] Patent Number: 5,490,823

[45] Date of Patent: Feb. 13, 1996

[54] WATER THERAPY AND FITNESS DEVICE

[76] Inventors: Brian J. Awbrey; Kipp K. Dye, both of 151 Merrimac St., Boston, Mass. 02114

[21] Appl. No.: 165,092

[22] Filed: Dec. 9, 1993

[51] Int. Cl.[6] ..... A63B 21/04; A63B 21/055

[52] U.S. Cl. ..... 482/55; 482/111; 482/124; 482/129

[58] Field of Search ..... 482/55, 111, 121, 482/122, 125, 126, 129, 131; 36/8.1, 29

[56] References Cited

U.S. PATENT DOCUMENTS

| | | | |
|---|---|---|---|
| 557,176 | 3/1896 | Whitely | 482/129 |
| 2,097,376 | 10/1937 | Marshman | 482/124 |
| 3,677,542 | 7/1972 | Richardson | 482/129 |
| 4,340,218 | 7/1982 | Wilkinson | 482/129 |
| 4,544,155 | 10/1985 | Wallenbrock et al. | 482/55 X |
| 4,948,117 | 8/1990 | Burke | 482/55 |
| 5,222,312 | 6/1993 | Doyle | 36/29 |

FOREIGN PATENT DOCUMENTS

| | | | |
|---|---|---|---|
| 2251473 | 4/1974 | Germany | 482/129 |
| 0024295 | 1/1899 | United Kingdom | 482/129 |

*Primary Examiner*—Richard J. Apley
*Assistant Examiner*—John Mulcahy
*Attorney, Agent, or Firm*—Edwin H. Paul; Jerry Cohen

[57] ABSTRACT

A water fitness, exercise and therapy system designed with an elastic tether (17) connected via pulley assembly (16) to shoe (31). The combination provides fitness training in varying depths of water (e.g. running, swimming, and therapeutic exercises). The present invention includes an adjustable buoyancy bladder attached to or constructed within the sole of the shoe where the bladder does not extend so as to interfere with normal running motions. The user expends energy by moving through the water and by stretching the tether.

2 Claims, 4 Drawing Sheets

WATER THERAPY AND FITNESS DEVICE

FIELD OF INVENTION

The present invention relates generally to an exercise and fitness device for use in water, e.g. a swimming pool, but the invention may be adapted for use on land. The invention is particularly related to such exercise equipment that use a tethered running system to provide a substantially complete water running/swimming/exercising (hereinafter collectively referred to as "training") system.

BACKGROUND OF THE INVENTION

The general continual rise in fitness awareness has led to an appreciation of the benefits of running for cardiovascular fitness. Along with this increasing popularity of fitness, sports and running over the past two-and-one-half decades, there has been explosive growth of the aquatic fitness and water rehabilitation therapy over the past ten years.

Approximately ten years ago, Glenn McWaters invented a water running vest, and since that time running has been increasingly popular. Many have now turned to water running as a training and fitness adjunct to enhance or maintain running efficiency and performance. Running in an upright (vertical) position in the water alleviates up to 90% of the effects of gravity (at shoulder level immersion)on the joints of the body. This greatly diminishes the impact placed upon the articular surfaces of the lower extremity joints (e.g. hips, knees, and ankles), as well as the spine, muscles and ligaments, in particular.

There are known in the art several types of water running shoes. One such design, found in U.S. Pat. No. 4,801,284, is a shoe with concentric flotation dishes on the underside of the shoes. These shoes allow the user to walk on the surface of the water. However, the concentric dishes extend much wider than the shoe itself to provide an area sufficient to give one stability on top of the water, but, the large surface area prevents the user from keeping his/her feet close enough to allow walking or running in a safe, functional and, biomechanically correct position.

Another device known in the art is the Hydro-Tone™ water resistive training device which attaches via a rubber boot to the lower legs. There are hard plastic plates longitudinally oriented along each tibia shin of the lower legs. The plate provides an increased resistance to motion through the water, because it increases the surface area presented to the water of the lower legs. A limitation of the Hydro-Tone™ system is that the plastic plate is wide and the user's legs must be spread apart. The legs cannot be held in the usual and preferred anatomical running position. Another limitation is that the hard plastic has protruding fins that can bruise or cut into the skin of the opposite leg during water running exercises or water sports.

It is an object of the present invention to provide a water training system where the user is able to train/exercise in a correct biomechanical position(s).

It is another object of the present invention to provide an fitness system for water running, swimming, and exercising where the user may assume various levels of immersion.

It is yet another object of the present invention to provide an adjustable buoyancy shoe-like device to accommodate different users and different levels of exercise intensities. Hereinafter, shoe device is defined as an apparatus that attaches to the human foot or ankle having attachment facilities to connect to the tether. The show device includes the facility for an adjustable buoyancy mechanism either as part of the shoe device or as a separate attachment.

SUMMARY OF THE INVENTION

The foregoing objects are met in a shoe device that is worn on the feet. The device includes a tether and spring combination or an elastic tether with one end attached to the shoe device with spring clip in a preferred embodiment. The user expends energy by working against the elastic tether that resists stretching. The other end of the tether is attached to a fixed station or location, or in another preferred embodiment the tether is looped over a hook, where the tether may slide, with one end of the tether attached to each foot.

The present invention provides for the user to be in a relatively anatomically safe position when water running with or without the tether. Water running is herein defined as performing running motions while being partially or fully immersed in water.

The shoe device, in a preferred embodiment, has an air bladder that is maintained substantially in the sole, and where the sole is not laterally extended beyond the width needed to fit and support the foot.

The present invention takes advantage of the fact that an immersed user expends energy as the user works against the elastic tether while the user moves through the water. The tether resists being stretched and water resists the movement of bodies through the water, e.g. track or swimming teams.

In a preferred embodiment, the present invention includes shoe-like devices that attach via an elastic tether to a stationary hook which is mounted on an elevated platform station. The station is fixed on the pool deck next to the pool, and there are a plurality of hooks to allow many simultaneous users.

This training system is used for running in a selected water depth, where the user can select not to touch the bottom of the pool, which minimizes compression forces on the lower extremity joints of the body. The device is protective of the foot and toes, provides an attachment to the tether, and provides protection to the plantar surface of the foot when used in shallow water or on land. One advantage of the present invention is an increased range of motion (ROM) that allows the user to increase one's own stride length, flexibility, strength and enhanced cardiovascular conditioning. Another advantage is that the present invention encourages proper anatomical posture, balance, and proprioception while stretching muscle (sO and other soft tissues. The present invention increases the functional capability of the user, that is the present training system invention increases the user's functional capability (e.g. walking, lifting, sitting, standing). An example, of how this system can increase functional capability of the user, is that when hamstring flexibility is increased the user will gain greater lumbar spinal mobility which can enhance lifting and ambulatory performance.

This device can also be adapted for swimming by placing the attachment hooks for the tether on the forefront of the shoe devices: either at the tongue, at the laces, or other upper portion of the shoe. By placing the attachment points (one for each shoe) above the metatarsophalangeal (MTP) joints it keeps the hooks out of the way for unimpeded swim training. In a preferred embodiment a user wears the shoe device with tether cords attached. The tether cords increase the length-tension characteristics as the user stretches the tether cord by moving the shoe devices in an appropriate direction. Such motion is an efficacious means for improving one's kicking strength and ankle flexibility as the user works against the tether cord while stretching the front of the ankle.

Yet another advantage of the present system for land and shallow water therapeutic exercise stems from the user being able to work by moving against a resisting element in substantially any direction. During deep water running the user must keep his head above water and use a floatation belt around the waist. The user is suspended at the level of the base of the neck with the belt around the user and the preferred embodiment on the feet with the tether cord attached.

On land, shallow or deep water the user can exercise in a vertical or horizontal prone (allowing enough space to breath) or supine position with varying positions in between for maximal therapeutic benefits (one must attain varying joint positions since the tissue fibers of the body are aligned in many directions).

Other objects, features and advantages will be apparent from the following detailed description of preferred embodiments thereof taken in conjunction with the accompanying drawings in which:

DETAILED DESCRIPTION OF THE PREFERRED EMBODIMENTS

Figure 1:
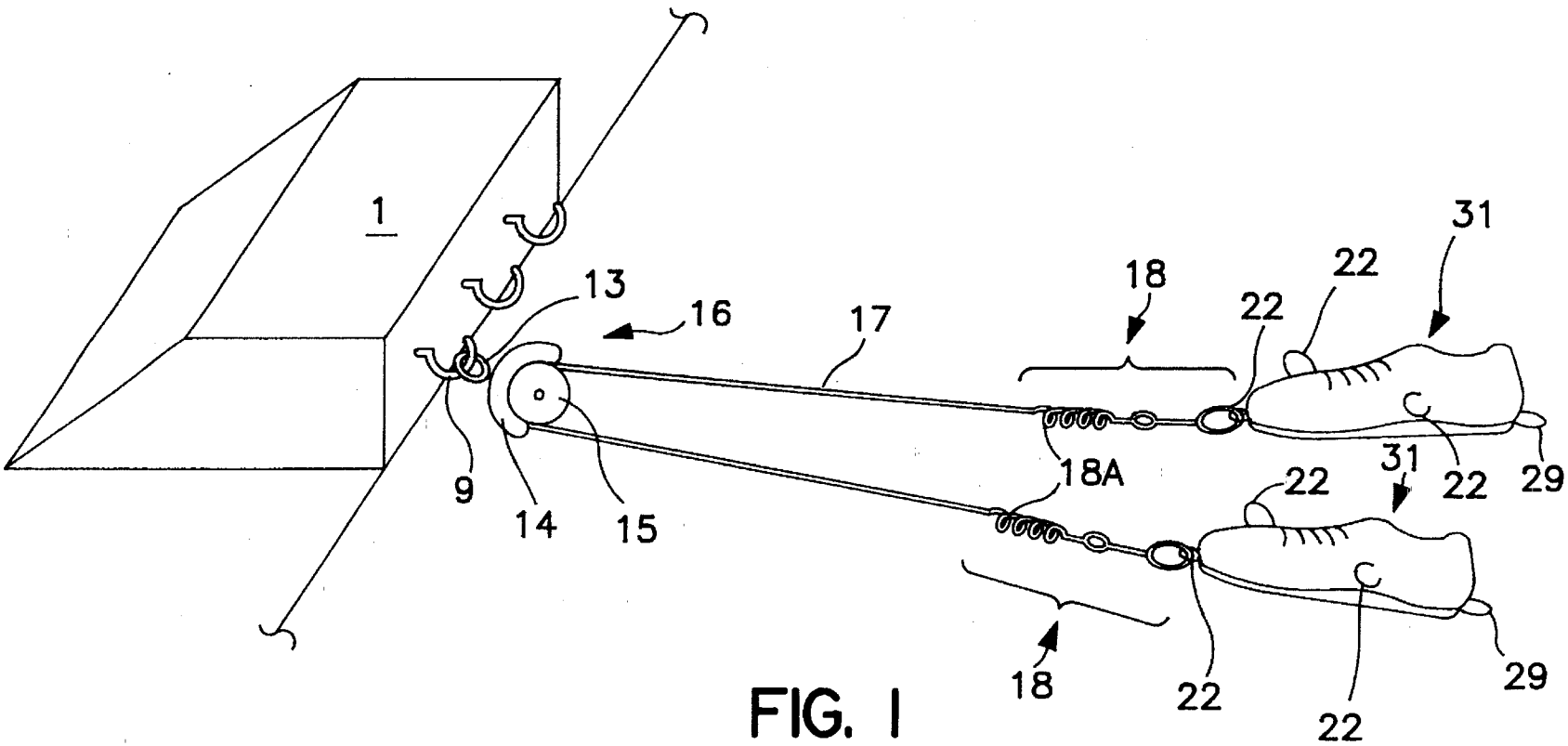
FIG. 1 is a pictorial of the invention including all components: the station with multiple hook attachments, the tether cord and pulley arrangement, and the shoes with the attachment sites.
Figure 2A:
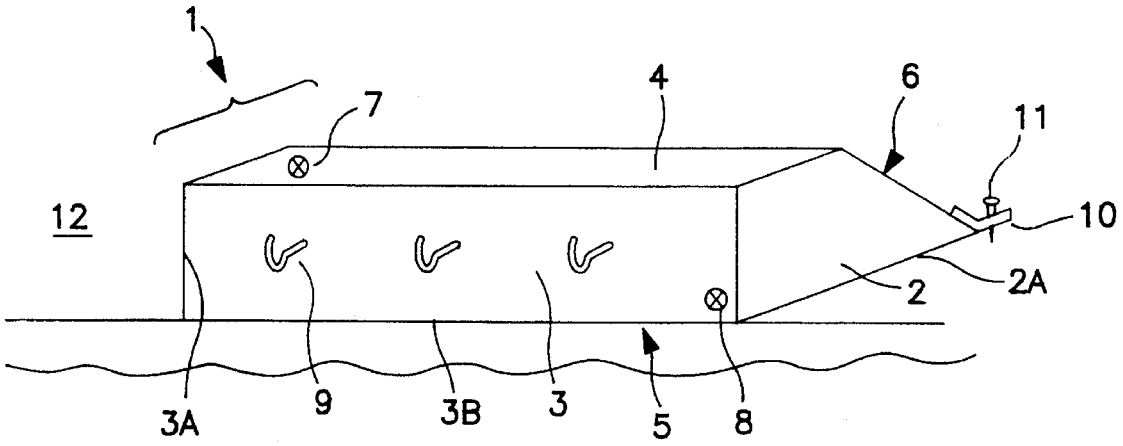
FIG. 2A is a detail of the station with multiple hooks.
Figure 2B:
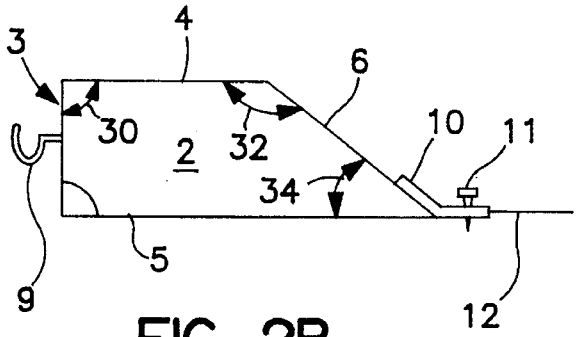
FIG. 2B is a side view of the station with hook design.
Figure 2C:
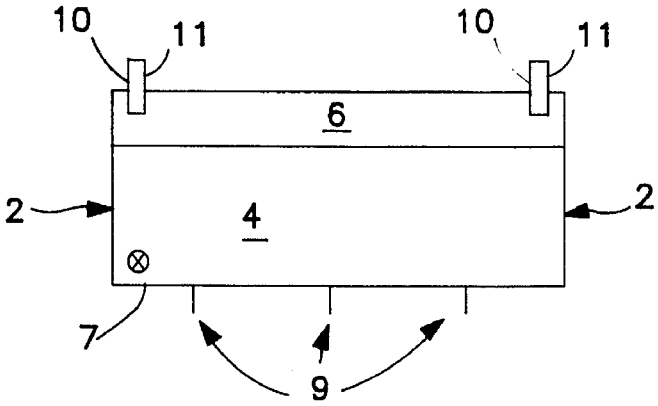
FIG. 2C is a top view of the station with hooks.

FIG. 1 depicts a complete water running system made in accordance with the present invention. The components are an anchoring station 1, fixed to the pool side deck, to which the tether 17 is attached via a swivel pulley 16 and a fixed hook 9. The swivel pulley assembly 16 includes an eyelet 13, wheel cover 14, and wheel 15, wheel axel 15A. With reference to FIG. 2A, a more detailed view of the pulley assembly shows a connecting member 15C that attaches at 15D to the axel and at 21 to the eyelet 13. The attachment 22 is a bearing type that allows the connecting member 15C to rotate 360° around the axis of the eyelet 13A. The attachment 22 is also a bearing type that allows the wheel 15 to rotate freely. There is a raceway 15B wherethrough the tether 17 passes smoothly. The swivel pulley assembly allows the pulley wheel axis to rotate a full 360 degrees to accommodate any tether orientation that the user may desire. In another preferred embodiment with no pulley assembly, the tether 17 is looped over (not shown) the stationary hook 9. In such a case, there will be substantial friction between the tether and the hook as the tether slides over the hook. The pulley assembly 16 acts to reduce this frictional interface.

At each end of the tether there are spring-loaded swivel hook assemblies 18 which attach to the front or side loops 22 or to the back loops 29 of the shoes. The tether is formed of an elastic (or part elastic) cord, but separate springs 18A are used in another preferred embodiment. The back loop 29 of each shoe, shown in FIG. 4A, includes a slide wire 28 that slides through a hole in the heel of the shoe. There is a loop 29 engaging the slide wire, and the loop 29 is connected to the spring loaded swivel hook assembly 18. The loop 29 can slide along the slide wire 28 allowing the user to stretch the tether with one foot and to resist such stretching with the other foot in directions not dictated by the loop 29 being attached only to the back of the shoe device. The further the user stretches the tether cords 17, the greater the tension within the tether cord. The user must generate a corresponding force resisting the tether, hence increasing the work load for the exerciser.

FIG. 2A shows in detail, a preferred embodiment of the pool side station 1. This device is of simple solid construction with a rectangular top 4, rectangular bottom 5, rectangular front 3, rectangular back 6 and two quadrilateral sides 2. The sides 2 having adjacent two square (90°) angles 30 and one acute (<90°) angle 34 adjacent to an obtuse (>90°) angle 32. The rectangular back 6 joins each of the two sides 2 at the side 2 edges that traverse the distance from angle 34 to 32.

The front side 3 of the station 1 is perpendicular to the pool deck 12, upon which it rests. The backside 6 is built at an oblique angle to the pool deck for three reasons. The first reason is that station material is saved; secondly, the oblique angle is less of a trip hazard; and thirdly, the oblique is more cosmetically pleasing.

The size of the platform 1, in this preferred embodiment, is at most one-fourth as high 3A as it is long 3B for stability, in this preferred embodiment, edge 3A is about four inches long (high) and edge 3B is about sixteen inches. In other preferred embodiments, the width of the station (3B) is as long as the pool side, and yet other preferred embodiments the width is only a few inches. The smaller length is determined via the above one-fourth ratio and by the height 3A required to secure the hooks 9 to the station. The station is fixed to the pool deck by two (or more) brackets 10 at the back of the station that attach to the station and to the deck. The brackets 10 are secured with concrete screws 11.

The screws 11 and brackets 10 are placed at the back (opposite side from the pool), or at the side back corners to ensure maximum stabilization of the station. It is required to have stability, because of the large forces pulling on the front side 3 of the station by the exerciser(s) via the tether cords 17. The station is designed to withstand the force placed upon each hook to ensure user safety.

The depth (in a direction away from the pool edge) of the station 2A is long enough to ensure that the hooks, as secured to the station, can withstand the forces generated by the users. Such distances are dependent upon the material used for the station and how the hooks attach. If the station is wood with screwed in hooks, the depth 2A will be greater than three inches, while plastic would required more than six inches, and steel less than an inch. The top surface 4 of the station 1 is arranged and designed to be skid proof to allow a coach, trainer, or physical therapist sure footing while monitoring the patient(s), and/or athlete(s). Such skid proof is a covering secured to the top 4, or the skid proofing is molded into the top and back surfaces.

There is no requirement for the station to be of solid construction. Hollow station designs are also used in other preferred embodiments. Other preferred embodiments use angle irons welded or formed together (not shown) to provide the mounting of the hooks 9 and the brackets 10, and to provide the strength to withstand the user generated forces. With angle iron the hooks are attached with nuts.

Referring to FIG. 2A, the hollow station is filled with water to provide stability. A valve 7 on top of the station, flush with the top surface 4, allows filling of the station, for example, from a hose. A drain 8 is placed on the lower front of the station to allow emptying of the water into the pool.

Figure 3:
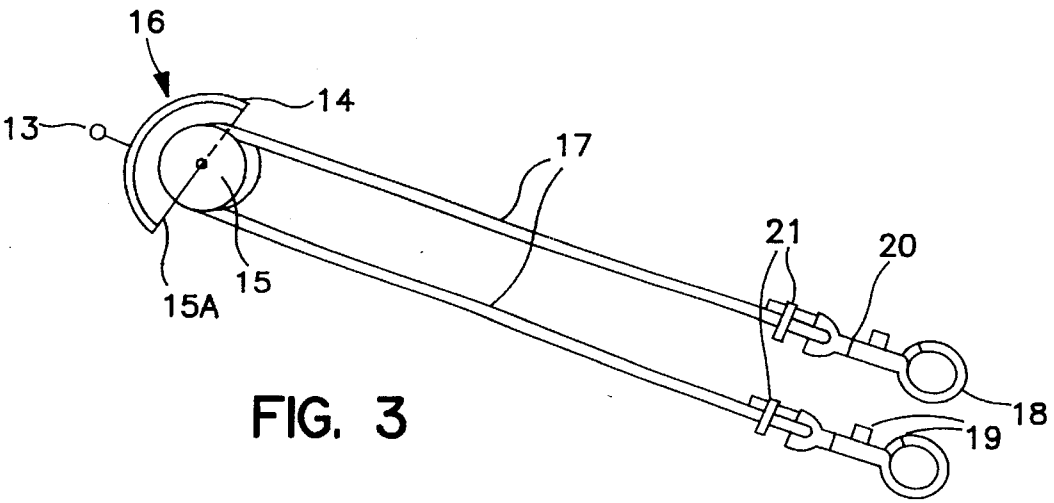
FIG. 3 is shows the spatial relationship between the pulley assembly, tether cord, and the spring-loaded swivel hooks.

FIG. 3 shows the tether 17, pulley assembly 16 with swivel hooks 18 at each end of the tether. In this preferred embodiment, the tether 17 is of an elastic material so that no separate springs are needed, and the tether has swivel hooks 18 at each end. The hooks 18 are provided with a safety fastener 20 which secures the elastic tubing to the swivel hooks. Each swivel 18 has full 360° rotation relative to the axis of the tether. This full range of rotation accommodates virtually any requirement of an exerciser and will prevent the tether from twisting.

FIG. 3 A shows a detail of the pulley assembly 16 where the pulley wheel 15 rides inside a housing 14, and the elastic tether 17 rides in the raceway 15B. The eyelet 13 connects to the hook(s) 9 on the front of the station. The eyelet 13 has a ball-bearing pivot junction 21 to the metal strap 15C. The pivot allows the pulley wheel 15 to rotate 360° around the eyelet axis 13A to maintain the tether straight in the raceway when in use. The tether cord 17 passes through the raceway 15B and around the pulley wheel 15 which is enclosed in a housing 14. The pulley wheel is centered and mounted to the axle 15A using a ball-bearing assembly. The enclosed raceway prevents the elastic tether 17 from shifting off the pulley 16 and becoming tangled in the pulley axle.

Figure 3B:
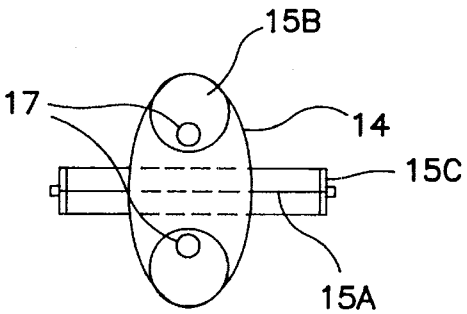
FIG. 3B is a cross sectional view of the pulley assembly.
Figure 3A:
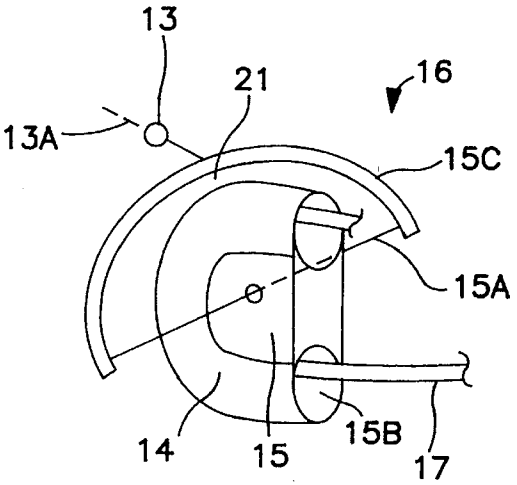
FIG. 3A is an oblique view of the pulley assembly.

FIG. 3B shows the raceway 15A and the wheel axle 15A and the tether 17.

Figure 4:
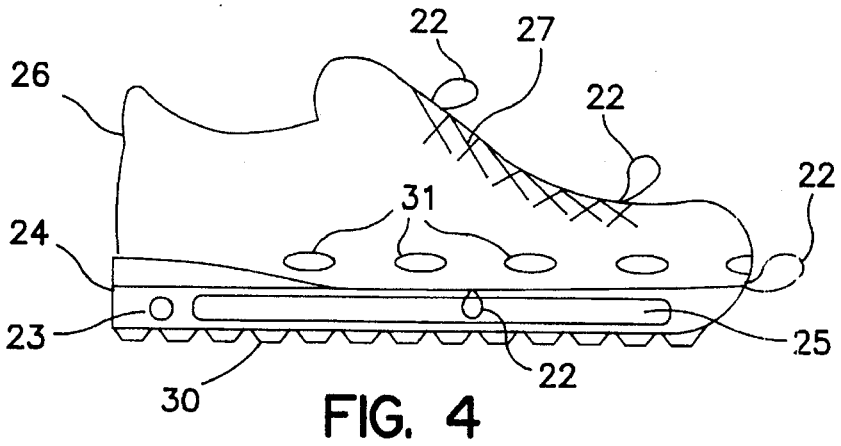
FIG. 4 is a lateral view of the shoe.

FIG. 4 shows a lateral view of the shoe component of a preferred embodiment. The shoe includes an upper shoe 26 and sole 24 that has a durable, traction enhancing thin bottom layer 30.

The tether cord 17 is able to attach to the shoes via a reinforced loops 22 that are placed on the front, both sides and on the upper front surface below the shoe laces or Velcro™ fastener 27. When the tether is attached to the forward loops 22 at the front and below the laces, the user runs backward (reverse) against the tension of the elastic tether for a workout. Reverse running emphasizes both concentric and eccentric conditioning of the posterior musculature of the trunk, hips, lower extremities, and feet.

Through holes 31 are provided along the perimeter of the upper shoe 26 to enhance drying of the shoes.

An air bladder 25 is designed into the sole of the shoe 24. The bladder can be inflated or deflated to provide an adjustable upward buoyant force This has therapeutic and competitive training value, because it can aid in the enhancement of kinesthetic awareness by means of the buoyant force it generates.

Figure 4A:
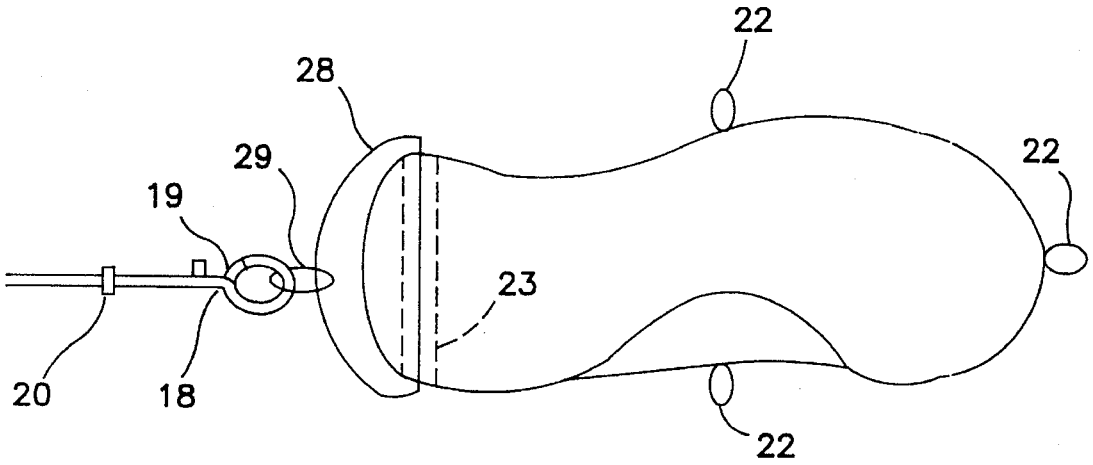
FIG. 4A is a bottom view of the shoe to show the spatial/functional relationship between the shoe, posterior shoe attachment, the spring-loaded swivel hook, and the tether cord.

FIG. 4A shows a hole 23 through the heel of the shoe. The hole 23 provides passage for the slide-wire 28. The hole 23 is centered and/or reinforced to prevent the slide-wire 28 from being torn out of the shoe due to forces generated via the tether cord 17 when in use. A spring loaded finger or thumb activated quick release 19 allows easy attachment of the tether to the slide wire 28 via a ring 29.

Figure 5:
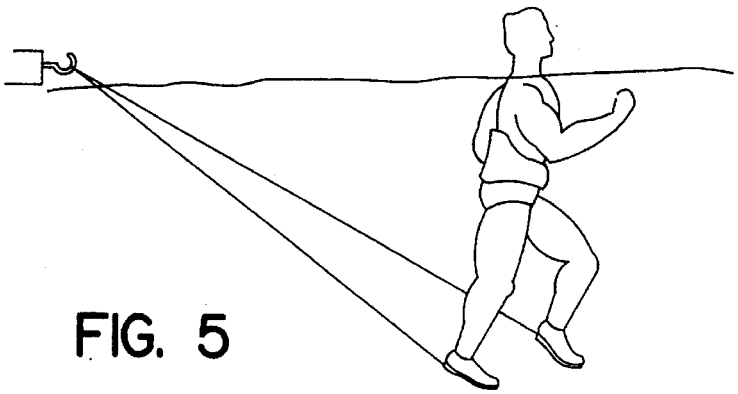
FIG. 5 is a functional pictorial of tethered running in a preferred embodiment.

FIG. 5 shows the human user immersed in water up to the neck with tether attachment to the back of the shoes as shown in FIG. 4A.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A water fitness, exercise and therapy apparatus for a human user comprising in combination:

(a) a pool containing water, (b) an elastic tether, (c) a shoe worn on each foot of the user, said shoe being arranged, constructed and adapted for use in said water and to accommodate a running action of the foot and ankle, a sole attached to the bottom of said shoe, an inflatable bladder to provide flotation buoyant force adjustment, where the bladder to attached to, constructed within, the sole, and where the bladder does not extend laterally from the shoe so that the user experiences no impediment to performance running motions with the user's lower extremities, (d) means to attach the tether to each shoe, (e) a fixed station attached to the side of said pool, (f) means for slidably retaining the tether to said fixed station, whereby the user trains by moving the user's legs and the shoes through said water and stretching the tether against the tether elastic force and where the tether slides at the fixed station to accommodate such training.

2. A water fitness, exercise and therapy apparatus for a human user comprising in combination:

(a) a pool containing water, (b) an elastic tether, (c) a shoe worn on each foot of the user, said shoe being arranged, constructed and adapted for use in said water and to accommodate a running action of the foot and ankle, a sole attached to the bottom of said shoe, an inflatable flotation bladder to provide flotation buoyant force adjustment, where the bladder is attached to, or constructed within, the sole, and where the bladder substantially covers the sole but does not extend laterally for the shoe so that the user experiences no impediment to performing running motions with the user's lower extremities, (d) means to attach the tether to each shoe (e) a fixed station attached to the side of said pool, (f) a pulley assembly attached to said fixed station, and where the tether engages the pulley wheel to substantially eliminate friction therebetween, whereby the user exercises by moving the user's legs through the water and by stretching the tether against the tether elastic force and where the tether passes via said pulley assembly the fixed station to accommodate such training.

* * * * *